US011311442B2

(12) United States Patent
Piontek et al.

(10) Patent No.: US 11,311,442 B2
(45) Date of Patent: Apr. 26, 2022

(54) INFLATABLE SURGICAL SUPPORT ACCESSORY HAVING SINGLE FAULT TOLERANCE

(71) Applicant: MAQUET GMBH, Rastatt (DE)

(72) Inventors: Manfred Piontek, Karlsruhe (DE); Siegfried Hund, Oberkirch (DE)

(73) Assignee: MAQUET GMBH, Rastatt (DE)

( * ) Notice: Subject to any disclaimer, the term of this patent is extended or adjusted under 35 U.S.C. 154(b) by 0 days.

(21) Appl. No.: 16/759,694

(22) PCT Filed: Oct. 30, 2018

(86) PCT No.: PCT/EP2018/079756
§ 371 (c)(1),
(2) Date: Apr. 27, 2020

(87) PCT Pub. No.: WO2019/086484
PCT Pub. Date: May 9, 2019

(65) Prior Publication Data

US 2020/0337928 A1 Oct. 29, 2020

(30) Foreign Application Priority Data

Oct. 30, 2017 (DE) ..... 10 2017 125 485.4

(51) Int. Cl.
*A61G 13/12* (2006.01)

(52) U.S. Cl.
CPC ..... *A61G 13/1265* (2013.01); *A61G 13/123* (2013.01)

(58) Field of Classification Search
CPC .... A61G 13/10; A61G 7/057; A61G 13/1265; A61G 13/04; A61G 13/12; A61G 13/0054; A61G 13/0009; A61G 13/122; A61H 23/02; A61B 6/0442
See application file for complete search history.

(56) References Cited

U.S. PATENT DOCUMENTS 5,613,254 A 3/1997 Clayman et al.

FOREIGN PATENT DOCUMENTS

| | | | |
|---|---|---|---|
| CN | 203841967 | U | 9/2014 |
| CN | 204274906 | U | 4/2015 |
| CN | 107224380 | A | 10/2017 |
| WO | 2017/064183 | A2 | 4/2017 |

OTHER PUBLICATIONS

International Search Report dated Jan. 31, 2019 during the prosecution of corresponding PCT application No. PCT/EP2018/079756, 2 pages.

*Primary Examiner* — Ophelia A Hawthorne

(57) ABSTRACT

Inflatable positioning equipment in the shape of an elongate roll for positioning a patient during a renal surgical procedure is provided. The positioning equipment includes: an inflatable covering which defines the external dimensions of the positioning equipment; a first air chamber system on the inside of the covering, which can be filled with air for inflating the covering; and a second air chamber system on the inside of the covering, which can be filled with air to inflate the covering. The second air chamber system is fluidically separated from the first air chamber system such that a leak in one air chamber system does not result in air loss in the other air chamber system.

18 Claims, 3 Drawing Sheets

INFLATABLE SURGICAL SUPPORT ACCESSORY HAVING SINGLE FAULT TOLERANCE

BACKGROUND

The present disclosure relates to an inflatable positioning equipment for positioning a patient during a surgical procedure.

TECHNICAL BACKGROUND

During surgical procedures, for example heart, rectal or renal surgery, the patient's body must be regularly stretched at the site of the procedure to ensure optimal conditions for the surgeon. This is usually achieved by lifting a part of the patient's body and then depositing it on a roller, cushion or the like to obtain the stretched position necessary for the surgical procedure. Examples of such known positioning equipment can be found in the specialist book "Positioning techniques in the operating theater" (Lagerungstechniken im OP-Bereich) by Krettek and Aschemann, published in 2005 by Springer Medizin Verlag, see the non-patent literature N1 attached to the application.

However, these rolls or cushions based on gel or foam have several disadvantages. For example, they do not allow dynamic adjustment of the stretched position of the patient during the surgery. In addition, the patient must first be lifted and held by the surgical staff before the pad can be placed underneath.

There are also several surgical tables with a firmly integrated body stretcher. This is a bench with a foam pad, which can be moved between a recessed posture in the surgical table and an extended posture. Such benches are used in particular in renal surgery for stretching the renal area of a patient. An example of such a known body stretcher is presented in the non-patent literature N2 attached to the application.

However, these integrated body stretchers require a high level of constructive effort in the development and manufacture of the surgical table, which thus becomes more expensive. In addition, the location of the patient has to be adapted to the fixed body stretcher, which can be painful and uncomfortable for the patient depending on the body dimensions. The positioning members should adapt to the patient and not vice versa.

OVERVIEW OF THE DISCLOSURE

Inflatable storage rolls are known from the care sector. However, these are not suitable for surgical use, as they do not provide the necessary safety against unintentional lowering of the patient during the operation. If there is a sudden leak in such an inflatable care roll, it will slump down due to the escaping air. During an operation, this would lead to an uncontrolled change in the patient's position, so that the patient could be injured. An example of such a known inflatable care roll is presented in the non-patent literature N3 attached to the application.

Furthermore, document DE 314 727 A discloses a circular draw sheet. Documents DE 759 394 A and DE 377 767 A relate to mattresses or mattress parts. Document DE 20 2017 002 188 U1 reveals in its FIG. 4 a leg sheet, which is therefore not suitable for use in renal surgery. Document DE 2 103 499 A shows an alternating pressure lying cushion. Document US 2010/0089411 A1 shows a mattress-like patient positioning system with numerous air cells. The air cushion known from AT 137 152 B has a single air chamber.

In view of the prior art described above, one of the objects of the present disclosure is to provide a positioning equipment for use in surgery which both ensures sufficiently reliable and safe positioning of the patient and allows faster, easier and dynamic positioning of the patient during a surgical procedure.

According to the disclosure, this object is achieved by means of the positioning equipment according to claim 1.

An inflatable positioning equipment in the shape of an elongate roll for positioning a patient during renal surgical procedure can be intended to be placed in a suitable place on an operating table to serve as a support for a body part of a patient so that the renal area of the patient can be brought into an extended position necessary for the renal surgical procedure. The positioning equipment can comprise the following:

- an inflatable covering which defines the external dimensions of the positioning equipment; and
- a first air chamber system on the inside of the covering, which can be filled with air for inflating the covering.

The inflatable positioning equipment can be characterized by the fact that it comprises a second air chamber system on the inside of the covering, which can be filled with air for inflating the covering. It can further be characterized in that the second air chamber system is fluidically separated from the first air chamber system so that a leak in one air chamber system cannot cause air loss in the other air chamber system.

By the providing of two separate air chamber systems, a local leakage in the positioning equipment, which always affects only one of the two air chamber systems, only leads to a slower and controlled slumping of the positioning equipment. It is also possible to counteract the slumping of the positioning equipment by pumping more air into the undamaged air chamber system.

As a result, the positioning equipment according to the disclosure is error-proof and suitable for use in surgery.

Exemplary embodiments of the positioning equipment according to the disclosure are given in the dependent claims.

For example, at least one of the two air chamber systems of the positioning equipment can have a plurality of air cells. Both air chamber systems can comprise several air cells each. The air cells of both air chamber systems can be arranged alternately within the covering.

The positioning equipment can extend along a longitudinal axis (X-X), wherein the air cells can be arranged in a row along this longitudinal axis.

In some embodiments the air cells can be disk-shaped.

At least one air chamber system can have a manifold for the supply of the air cells allocated to it. Each manifold can be realized as an elongated air bag. The positioning equipment can be transformed by inflating it from a flat rectangular shape in plan view into a bulging roll form.

The positioning equipment can have a drop-shaped or symmetrical, e.g. mushroom-shaped cross-section when inflated.

The positioning equipment can be provided with an air pressure monitoring means to monitor the level of air pressure in the two air chamber systems, such as a manometer.

The positioning equipment can comprise an air pump for inflating the covering.

In some embodiments, the positioning equipment can comprise a control device. The control device may be adapted to receive, for example, air pressure values from the air pressure monitoring means and to determine from the received air pressure values whether the air pressure in one of the air chamber systems is dropping. The control device can also be adapted to compensate, by means of the pump, for a drop in air pressure in one of the air chamber systems by increasing the air pressure in the other air chamber system, thus preventing a patient placed on the positioning equipment from lowering.

The positioning equipment can have a covering which is provided with a padding, e.g. made of foam.

The positioning equipment can comprise a T-piece for connecting an air pump to the two air chamber systems.

In some embodiments, the positioning equipment can have one lock valve per air chamber system, by means of which the associated air chamber system can be fluidically separated from an air source.

The positioning equipment can have a mushroom-shaped cross-section when inflated. Both air chamber systems can each comprise several air cells, wherein the air cells of both air chamber systems can be arranged alternately within the covering.

BRIEF DESCRIPTION OF THE DRAWINGS

With reference to the figures, two exemplary embodiments of the positioning equipment according to the disclosure are now described, wherein.

DETAILED DESCRIPTION

Figure 1:
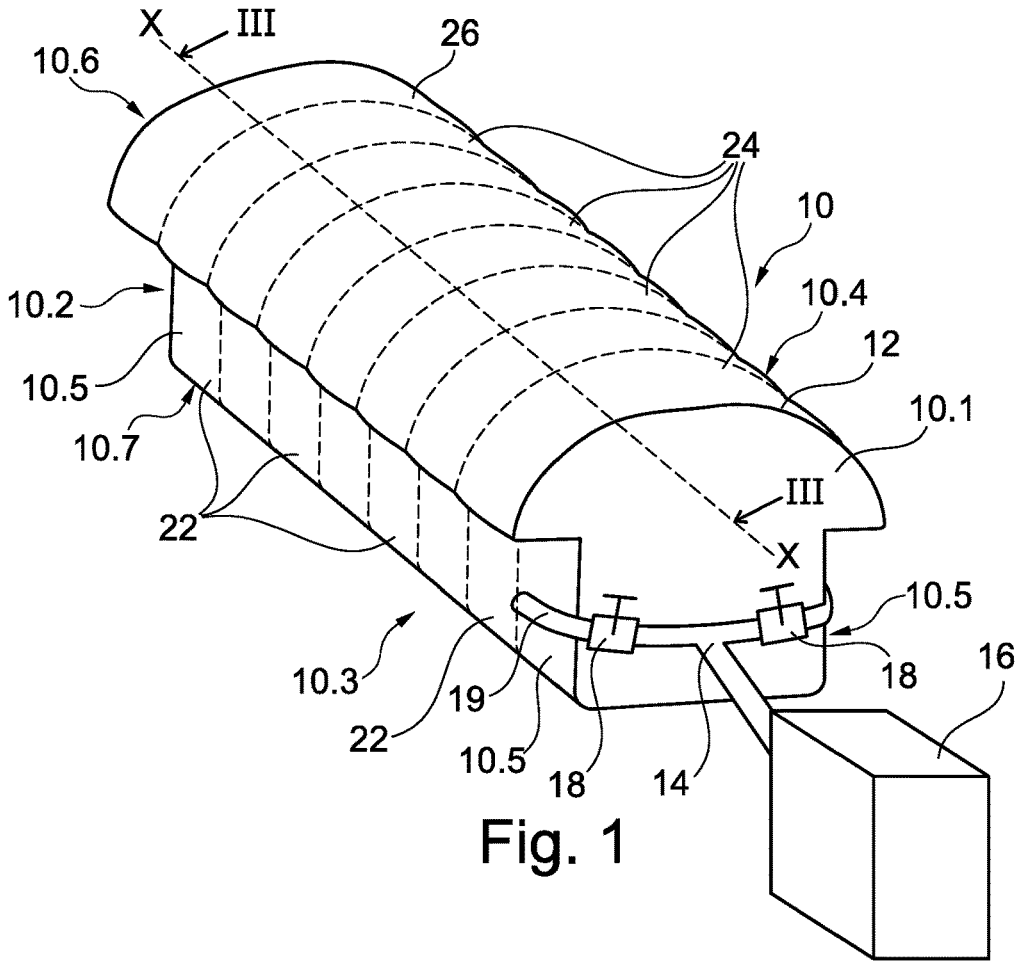
FIG. 1 is a perspective view of a first embodiment of the positioning equipment according to the disclosure.

FIG. 1 shows a first embodiment 10 of a positioning equipment according to the disclosure. This positioning equipment has an inflatable covering 12, which defines the outer dimensions of the positioning equipment 10. For example, the covering 12 of the positioning equipment 10 can be fitted with padding, e.g. foam, to provide a more comfortable positioning of the patient.

The positioning equipment 10, when inflated as shown in FIG. 1, has substantially a tin loaf shape. The shape of the positioning equipment 10 is therefore substantially that of an elongated roll. When inflated, the cross-section of the positioning equipment 10 is mushroom-shaped. The mushroom head provided by the mushroom shape has a large contact surface and thus exerts far less surface pressure on the patient. This avoids serious postoperative injuries such as decubitus or nerve separations.

The positioning equipment 10 extends along a longitudinal axis X-X. It has a front side 10.1, a rear side 10.2, two longitudinal sides 10.3 and 10.4, an upper side 10.6 and an underside 10.7. The end areas of the longitudinal sides 10.3, 10.4 bear the reference sign 10.5.

The underside 10.7 serves as a contact surface with which the positioning equipment 10 rests on the operating table during use. The contact surface 10.7 is best formed to be flat in order to provide more safety against twisting or tilting of the positioning equipment 10. A flat forming also minimizes the sinking of the positioning equipment 10 into the padding of the operating table.

The longitudinal sides 10.3 and 10.4 preferably run straight when inflated and form a substantially right angle in relation to the underside 10.7. Thus, the longitudinal sides 10.3 and 10.4 run substantially vertically when in use on the operating table, whereby the positioning equipment 10 has a greater stroke between the deflated and the maximum inflated state than with curved longitudinal sides.

The positioning equipment 10 is connected to an air pump 16 via a T-piece 14. The T-piece 14 has two lock valves 18, each of which can be located in an air hose 19 of the T-piece 14. For example, one of the two air hoses 19 is connected in the end area 10.5 of one 10.3 of the two longitudinal sides of the positioning equipment 10, and the other air hose 19 is connected in the end area 10.5 of the opposite longitudinal side 10.4 of the positioning equipment 10. By placement of the air hoses 19 in this way, they cannot be squeezed out when the patient is lying on the positioning equipment 10.

Via the air pump 16, which can be a hand pump or a motor-driven pump, the positioning equipment 10 is inflated. The air is distributed via the T-piece 14 to two separate air chamber systems of the positioning equipment 10. With the lock valves 18, each of the two air chamber systems can be separated fluidically from the air pump 16.

Figure 2:
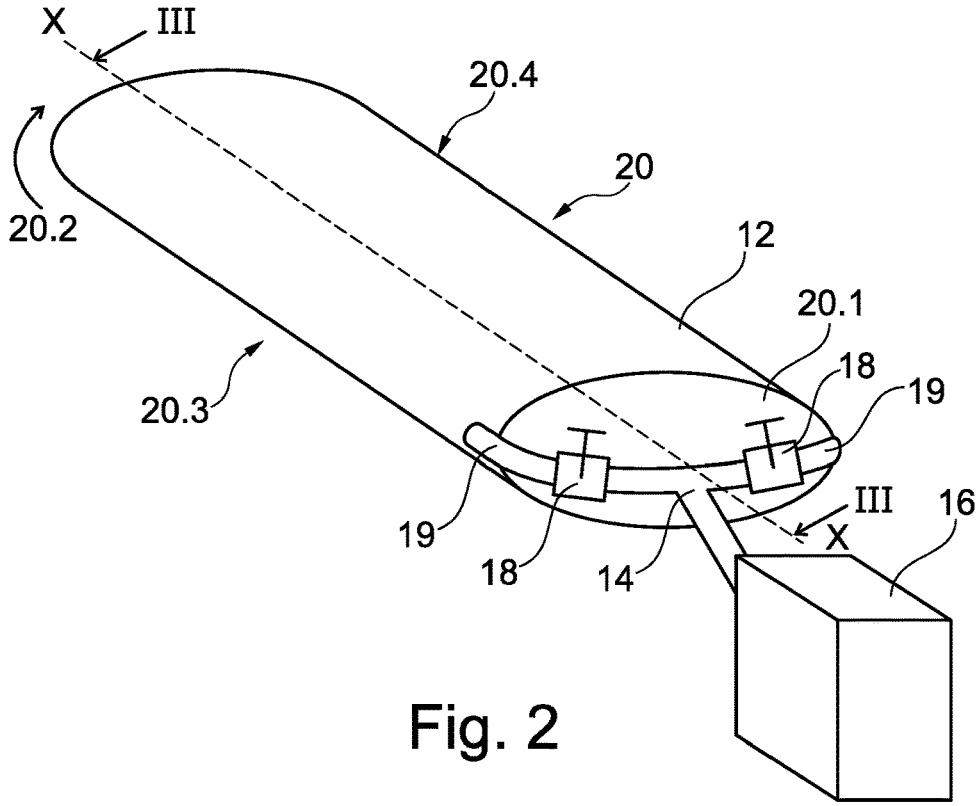
FIG. 2 shows a second embodiment of the positioning equipment according to the disclosure.

FIG. 2 shows a second embodiment 20 of the positioning equipment according to the disclosure. The positioning equipment 20 differs from the positioning equipment 10 by its different cross-section, which in this case is drop-shaped. Otherwise, both positioning equipment 10 and 20 are identical.

Figure 3A:
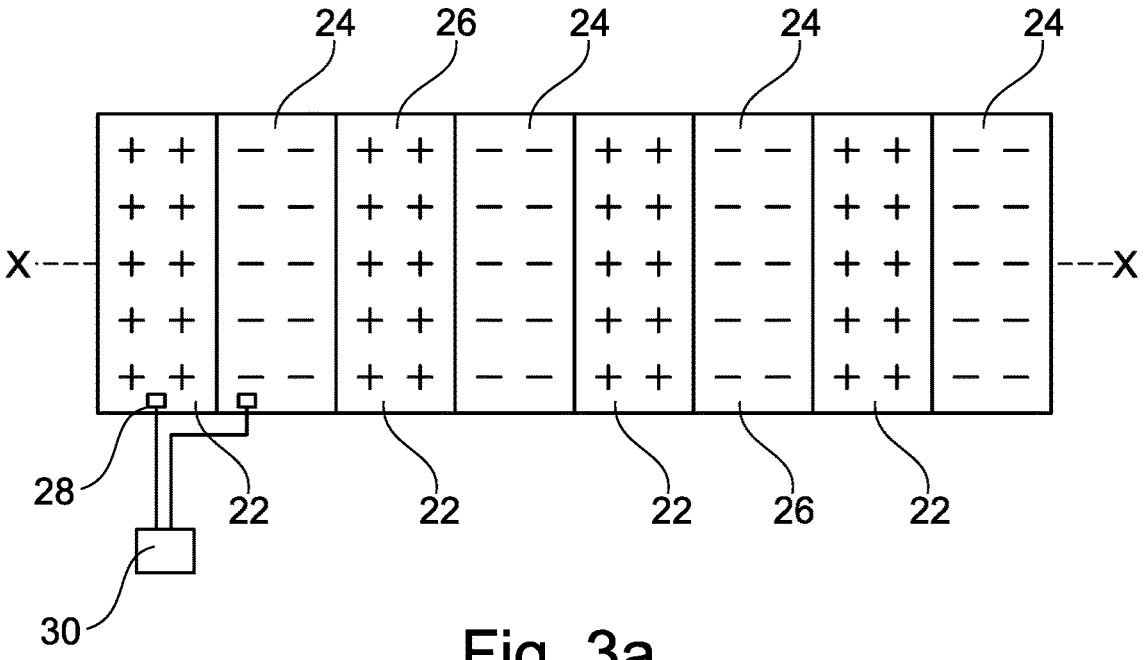
FIG. 3*a* is a schematic longitudinal section according to III-III in FIGS. 1 and 2.

FIG. 3*a* schematically shows a longitudinal section of the positioning equipment 10, 20, showing the two separate air chamber systems 22, 24, each of which have four air cells 26 in the example shown. The air cells of the air chamber system 22 are marked by the +, while the air cells of the other system 24 are marked by the −. As can be seen, the air cells 26 of the two air chamber systems are arranged alternately within the covering 12, for example. For example, the air cells 26 are arranged in a row along the longitudinal axis X-X. Apparently, the first air chamber system 22 is fluidically separated from the second system 24, i.e. a leak in one air chamber system does not lead to air loss in the other air chamber system. The air cells 26 can be disk-shaped within the positioning equipment 10, 20.

It should be emphasized that the number of air chamber systems 22, 24 and the number of air cells 26 can be freely selected depending on the size of the positioning equipment 10, 20.

For example, pressure gauges 28 can be provided in the air cells 26 or in the air pipes. Such an air pressure monitoring means for monitoring the level of air pressure in the two air chamber systems 22, 24 can, for example, operate with pressure sensors 28. The pressure sensors 28 can transmit measured air pressure values to a control device 30. This can determine whether the air pressure in an air chamber system is dropping and initiate appropriate countermeasures. For example, the control device 30 could control the pump 16 to increase the pressure in the air chamber system not affected by the pressure drop until the original lifting height of the positioning equipment 10, 20 before the leakage and thus the original patient stretching is reached again.

Air pressure monitoring can be carried out alternatively or additionally by visual inspection, e.g. by the anesthetist, if the positioning equipment 10, 20 is equipped with a pressure indicator for each independent air chamber system. For example, such pressure indicators are located on the air hoses 19.

Figure 3B:
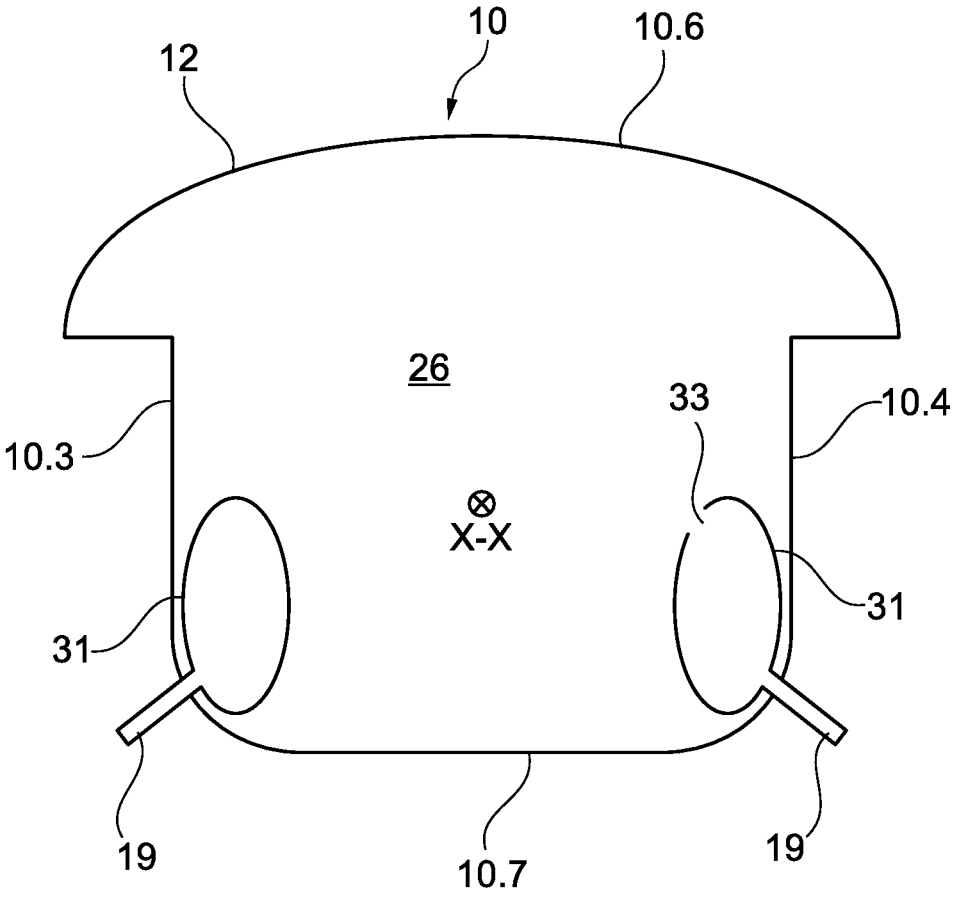
FIG. 3*b* is a schematic cross-section of the positioning equipment in FIG. 1.

FIG. 3*b* shows one of the air cells 26 in cross-section. Along each of the longitudinal sides 10.3 and 10.4 within the covering 12, two manifolds 31 can be seen. The manifolds 31 each belong to one of the two air chamber systems 22, 24. Each manifold 31 supplies the air cells 26 assigned to it with compressed air via openings 33. Each air hose 19 is connected to one of the two manifolds 31.

In some embodiments each manifold 31 is realized as an air bag extending in the direction of the longitudinal axis X-X from the front side 10.1 to the rear side 10.2. This air bag 31 can in particular be welded to the covering 12. This construction has two advantages over compressed air hoses: firstly, the air bags form no or hardly any artefacts on the X-ray image during X-ray. On the other hand, the patient lies more comfortably on the air bags 31, which are obviously suitable for X-ray imaging, than on hoses.

Figure 4A:
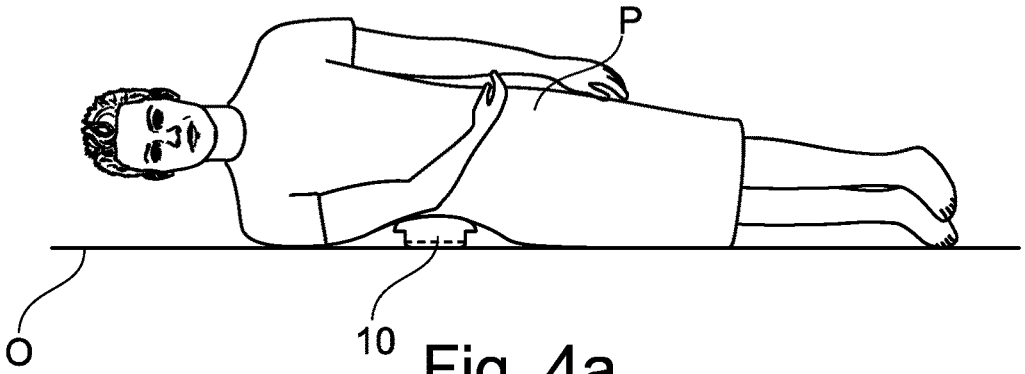
FIG. 4 illustrate exemplarily the use of the positioning equipment, according to the disclosure, on the patient.
Figure 4B:
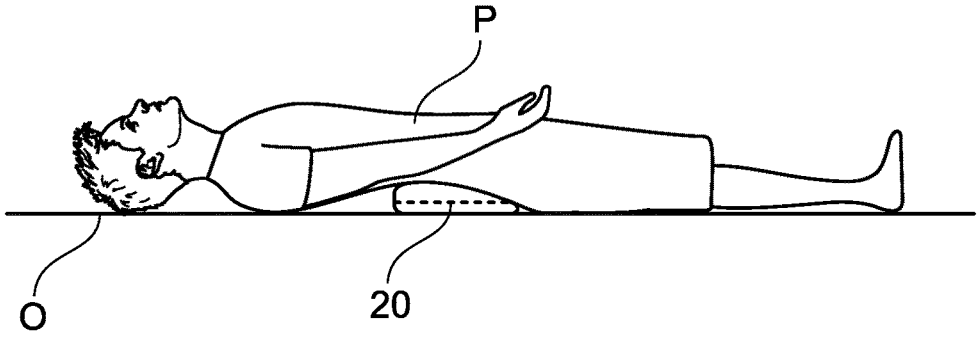

FIGS. 4*a* and 4*b* exemplarily show the use of the positioning equipment 10, 20 during a surgical procedure.

First of all, the inflatable positioning equipment 10, 20 is placed on the operating table in a deflated state at the appropriate place. In the deflated state, the positioning equipment 10, 20 has a rectangular shape in plan view.

The deflated condition of the positioning equipment 10, 20 is indicated by dotted lines in FIGS. 4*a* and 4*b*. Patient P is then placed on the operating table O so that he lies on the positioning equipment 10, 20. Now the positioning equipment 10, 20 is inflated with the pump 16 to bring the patient into the stretched position.

FIG. 4*a* shows a patient positioned in a lateral position on an operating table, with an elongated positioning equipment 10, 20 with a mushroom-shaped cross-section positioned on the operating table to support the patient's waist area. Such a placement is very helpful, for example, in renal operations. FIG. 4*b* also shows an elongated positioning equipment 10, 20 with a wing-shaped cross-section, which supports the patient's back area.

If a leak occurs in the positioning equipment 10, 20 during operation, the surgical team can disconnect the affected air chamber system from the air supply by means of the associated lock valve 18. The pump 16 can then be used to supply the intact air chamber system with additional air to prevent the positioning equipment 10, 20 from sinking. This process can be carried out not only manually by the surgical staff but also fully automatically by means of the control device 30.

In addition, it is possible to dynamically adjust the position of patient P during the surgery using the positioning equipment 10, 20 according to the disclosure. For this purpose, the positioning equipment 10, 20 is simply accordingly inflated or deflated.

The end areas 10.5 of the two longitudinal sides 10.3, 10.4 of the inflatable positioning equipment 10, 20 can, for example, be defined without restriction as areas which are 10% or 20% of the length of the longitudinal sides 10.3, 10.4 and extend from the front side 10.1 or the rear side 10.2 to the center of the positioning equipment 10, 20. The end areas 10.5 can alternatively be defined as areas which are, for example, 5, 10 or 20 centimeters of the length of the longitudinal sides 10.3, 10.4 and are closest to the respective front side 10.1 or the rear side 10.2. The end areas 10.5 of the two longitudinal sides 10.3, 10.4 also correspond to the portions of the longitudinal sides 10.3, 10.4 where the two air hoses 19 of the T-piece 14 are connected.

The present disclosure also concerns a positioning equipment 10, 20 which comprises at least three separate air chamber systems 22, 24, each of the air chamber systems 22, 24 having separate ports for air hoses 19 and lock valves 18.

According to the disclosure, each air chamber system 22, 24 can comprise an individual manifold 31. Each manifold 31 can be fluidically connected via openings 33 both to an air hose 19 associated with it and to each of the plurality of air cells 26 of the air chamber system 22, 24.

Each manifold 31 can supply compressed air to its assigned plurality of air cells 26, e.g. via a single opening 33 connected to an air hose 19.

For example, the manifolds 31 are made of a soft and radiolucent material that can expand under pressure and shrink together with other parts of the positioning equipment 10, 20.

This disclosure also relates to methods for supporting and placing patients on a treatment table (e.g. an operating table) during a medical procedure. An exemplary method can comprise the following steps:

- placing a positioning equipment 10, 20 in a suitable place on a surgical table;
- placing a patient on the positioning equipment 10, 20;
- inflating the positioning equipment 10, 20 until a desired expansion rate is reached;
- performing a medical procedure on the patient.

This exemplary method can be a renal surgical procedure in which the positioning equipment 10, 20 is placed on an operating table in a suitable place and then inflated to bring the patient's renal area into a stretched position.

In some methods two or more separate air chamber systems 22, 24 are inflated before and during the method. According to the disclosure, the method described above can include an additional step that is performed if one of the air chamber systems 22, 24 fails during a patient procedure. The additional step can be carried out as follows:

- Separating a leaking or faulty air chamber system 22, 24 of the positioning equipment 10, 20 from an air source by means of a lock valve 18 and/or maintaining a faultlessly functioning air chamber system 22, 24 in an inflated condition after the failure of the faulty air chamber system 22, 24 to prevent a lowering of a patient placed on the positioning equipment 10, 20.

In some embodiments, the positioning equipment 10, 20 in the inflated state can have a length that is at least twice or at least three times its maximum thickness. In some embodiments, the positioning equipment 10, 20 can have a substantially straight and linear shape. In some embodiments, the positioning equipment 10, 20 can be elongated and, when inflated, have an oval, rectangular, mushroom, muffin, wedge, square, circular or aircraft wing-shaped cross-section.

In summary, the positioning equipment according to the disclosure offers, in particular, the following advantages:

- The positioning equipment 10, 20 lies flat against the padding of the operating table during use. In this way there is a direct transition between the positioning equipment 10, 20 and the operating table, without any gap in between. Such unwanted gaps exist with the well-known body stretchers integrated into the operating table. In such gaps the patient can get trapped and suffer serious post-operative injuries.

Any placement of the positioning equipment on the operating table. The positioning equipment can be freely placed on the operating table and can be easily readjusted if necessary.

Polytraumatized patients: If indicated, any number of positioning equipment can be used on an operating table. This is not possible with the previous integrated body stretchers.

For example, the surface pressure on the patient is lower than with conventional body stretches due to the shape and composite structure of a compressible air body with a soft outer skin and the integrated foam.

The invention claimed is:

1. Inflatable positioning equipment for positioning a patient (P) during a renal surgical procedure, the positioning equipment being configured to be placed on an operating table to serve as a support for a body part of a patient, such that the renal area of the patient is brought into a stretched position necessary for the renal surgical procedure, wherein the positioning equipment comprises:

an inflatable covering which defines external dimensions of the positioning equipment;

a first air chamber system inside of the covering, which can be filled with air for inflating the covering; and a second air chamber system inside of the covering which can be filled with air to inflate the covering;

wherein the positioning equipment is shaped as an elongate roll; and wherein the second air chamber system is fluidically separated from the first air chamber system such that a leak in one air chamber system does not result in air loss in the other air chamber system.

2. Positioning equipment according to claim 1, wherein at least one of the first air chamber system and the second air chamber system has multiple air cells.

3. Positioning equipment according to claim 2, wherein the first air chamber system and the second air chamber system each comprise a plurality of air cells, and wherein the air cells of the first air chamber system and the second air chamber system are arranged alternately within the covering.

4. Positioning equipment according to claim 2, wherein the positioning equipment extends along a longitudinal axis (X-X), and wherein the air cells are arranged in a row along this longitudinal axis (X-X).

5. Positioning equipment according to claim 2, wherein the air cells are disk-shaped.

6. Positioning equipment according to claim 2, wherein at least one air chamber system has a manifold for supplying the air cells associated therewith, each manifold being shaped as an elongated air bag.

7. Positioning equipment according to claim 1, wherein the positioning equipment can be converted by inflating from a flat shape which is rectangular in plan view into a bulging roll shape.

8. Positioning equipment according to claim 1, wherein the positioning equipment has a mushroom-shaped cross section when inflated.

9. Positioning equipment according to claim 1, comprising an air pressure monitor for monitoring the level of air pressure in the first air chamber system and the second air chamber system.

10. Positioning equipment according to claim 1, further comprising an air pump for inflating the covering.

11. Positioning equipment according to claim 1, further comprising:

an air pressure monitor, the air pressure monitor configured to measure air pressure values in the positioning equipment;

an air pump, the air pump being configured for inflating at least one of the first air chamber system and the second air chamber system; and a control device;

wherein the control device is arranged to:

receive air pressure values from the air pressure monitor;

determine, based on the received air pressure values, whether the air pressure in one of the first air chamber system and the second air chamber system is decreasing; and in response to the air pressure in one of the first air chamber system and the second air chamber system dropping, compensating by using the air pump to increase the air pressure in the other of the first air pressure system and the second air pressure system, in order to prevent lowering of a patient positioned on the positioning equipment.

12. Positioning equipment according to claim 1, wherein the covering is fitted with foam padding.

13. Positioning equipment according to claim 1, further comprising:

an air pressure monitor, the air pressure monitor configured to measure air pressure values in the positioning equipment;

an air pump, the air pump being configured for inflating the first air chamber system and the second air chamber system; and a T-piece connecting the air pump to the first air chamber system and the second air chamber system.

14. Positioning equipment according to claim 1, further comprising:

an air source;

a first lock valve fluidically separating the first air chamber system from the air source; and a second lock valve fluidically separating the second air chamber system from the air source.

15. Positioning equipment according to claim 1:

wherein the positioning equipment has a mushroom-shaped cross-section when inflated, wherein the first air chamber system and the second air chamber system each comprise a plurality of air cells, and wherein the air cells of the two air chamber systems are arranged alternately within the covering.

16. Inflatable positioning equipment having a mushroom-shaped cross section for positioning a patient (P) during a renal surgical procedure, the positioning equipment being configured to be placed on an operating table to serve as a support for a body part of a patient, such that the renal area of the patient is brought into a stretched position necessary for the renal surgical procedure;

wherein the positioning equipment comprises:

an inflatable covering which defines external dimensions of the positioning equipment;

a first air chamber system inside of the covering, which can be filled with air for inflating the covering; and a second air chamber system inside of the covering which can be filled with air to inflate the covering, wherein the positioning equipment is elongated, and has a mushroom-shaped cross section; and wherein the second air chamber system is fluidically separated from the first air chamber system such that a leak in one air chamber system does not result in air loss in the second air chamber system.

17. Positioning equipment according to claim 16:

wherein the first air chamber system and the second air chamber system each comprise a plurality of air cells;

wherein the positioning equipment extends along a longitudinal axis (X-X);

wherein air cells of the first air chamber system and air cells of the second air chamber system are arranged alternatingly in a single row along the longitudinal axis (X-X).

18. Inflatable positioning equipment for positioning a patient (P) during a renal surgical procedure, the positioning equipment being configured to be placed on an operating table to serve as a support for a body part of a patient, such that the renal area of the patient is brought into a stretched position necessary for the renal surgical procedure;

wherein the positioning equipment comprises:

an inflatable covering which defines external dimensions of the positioning equipment;

a first air chamber system inside of the covering, which can be filled with air for inflating the covering;

a second air chamber system inside of the covering which can be filled with air to inflate the covering, an air pressure monitor, the air pressure monitor configured to measure air pressure values in the positioning equipment;

an air pump, the air pump being configured for inflating the first air chamber system and the second air chamber system; and a controller operatively connected to the air pressure monitor and the air pump;

wherein the positioning equipment is elongated;

wherein the second air chamber system is fluidically separated from the first air chamber system such that a leak in one air chamber system does not result in air loss in the second air chamber system; and the controller being configured wherein in response to the air pressure monitor measuring an air pressure drop in one of the first air chamber system or the second air pressure system, the air pump automatically increases air pressure in the other of the first air pressure system and the second air pressure system to prevent lowering of a patient supported by the positioning equipment.

* * * * *